US005921752A

United States Patent [19]

Sinke et al.

[11] Patent Number: 5,921,752

[45] Date of Patent: Jul. 13, 1999

[54] FLAT SPINE SCORER AND SADDLE STITCHER

[75] Inventors: David P. Sinke, Rockford; Douglas Baas, Grandville, both of Mich.

[73] Assignee: Dickinson Press, Inc., Grand Rapids, Mich.

[21] Appl. No.: 09/065,338

[22] Filed: Apr. 23, 1998

Related U.S. Application Data

[60] Provisional application No. 60/044,799, Apr. 24, 1997.

[51] Int. Cl.[6] ..... B42C 5/02; B42B 2/02; B42B 9/00

[52] U.S. Cl. ..... 416/16; 416/19; 416/20; 416/21; 416/28; 416/33; 416/35

[58] Field of Search ..... 412/16, 19, 20, 412/21, 28, 33, 35

[56] References Cited

U.S. PATENT DOCUMENTS

| | | |
|---|---|---|
| Re. 32,410 | 5/1987 | Mayer . |
| 1,196,912 | 9/1916 | Weck . |
| 1,525,238 | 2/1925 | Hurd . |
| 3,561,752 | 2/1971 | McCain et al. . |
| 4,294,182 | 10/1981 | Böttcher et al. . |
| 4,410,170 | 10/1983 | Wertheimer et al. . |
| 4,519,599 | 5/1985 | Mayer . |
| 4,522,384 | 6/1985 | Beckley . |
| 4,907,791 | 3/1990 | Higgins et al. . |
| 5,028,193 | 7/1991 | Misicka . |
| 5,045,045 | 9/1991 | Davenport et al. . |
| 5,100,116 | 3/1992 | Graushar . |
| 5,133,235 | 7/1992 | DeVito . |
| 5,158,273 | 10/1992 | Wagner . |
| 5,326,088 | 7/1994 | Newsome . |

*Primary Examiner*—Willmon Fridie, Jr.
*Assistant Examiner*—Mark T. Henderson
*Attorney, Agent, or Firm*—Varnum, Riddering, Schmidt & Howlett LLP

[57] ABSTRACT

An improved saddle stitching apparatus has dual scoring disks which cooperate with a scoring drum to create a flat spine on a cover. In one embodiment, a split ring is provided with two clamp arms, so that the ring can be releasably secured to the scoring drum. The ring includes a pair of annular grooves, with the distance between the grooves being of the desired spine width. The scoring disks are positioned adjacent the grooves so as to form the scoring lines. A folding assembly is also disclosed, which utilizes a flat carrying belt and a V-belt for purposes of folding the cover and moving the cover toward a stitching station. A gathering chain is also utilized to deliver the cover and signatures to the stitching station. The station includes a guide to assist in directing the preassembled covers and signatures toward a stitching head. Also provided is a block guide and an anvil for assistance in centering the spine beneath the stitching head. The stitching head delivers a saddle stitch in the center of the spine.

19 Claims, 4 Drawing Sheets

FLAT SPINE SCORER AND SADDLE STITCHER

PRIOR APPLICATIONS

This application claims priority of the United States Provisional Application Ser. No. 60/044,799 filed Apr. 24, 1997.

BACKGROUND OF THE INVENTION

1. Field of the Invention

This invention relates generally to bookbinding and, more particularly, to a device for scoring a flat spine cover, and binding the publication with a saddle stitch.

2. Description of the Related Art

Scoring, collating, binding, and trimming systems are thoroughly conventional in the printing industry. Such systems must be capable of efficiently producing, in high volume and at high speeds, books of various numbers of pages formed of paper stock of different sizes, weights and finishes.

Books are ordinarily composed of "signatures." A signature is simply a folded sheet presenting four pages (two sheets) of the book. In the instance of small books such a magazines, newspaper supplements, entertainment guides, catalogs of limited size and the like, the signatures to comprise the book are fed from supply hoppers and are gathered, one atop another, on a conveyor or gathering chain. The signatures are stored in a supply stack in signature feeders, which are aligned in rows of multi-unit sections, also known in the art as "boxes" or "pockets." Each of these signature feeders extracts a single folded signature from its supply stack, opens the signature and delivers it, with its fold in draped fashion upon a collating gathering chain which travels directly in front of the aligned signature feeders. Such feeders are well known and are disclosed, for example, in U.S. Pat. No. 2,251,943 issued Aug. 12, 1941, to Kleineberg. The conveyor delivers each group of signatures below a cover scoring and folding device, where a scored and folded cover is fed atop each group of signatures constituting an unbound book on the gathering chain. The covered, unbound books are further carried by gathering chain to a binding station, where a stitch is inserted or an adhesive is applied to he gathered signatures to complete a bound book. Once bound, the gathering chain transports he books to a trimming device, which trims excess from the unbound edges of the newly-formed book. The completed books are then stacked.

A large portion of the bookbinding market is for booklets of one-quarter inch thickness or less. In the binding of magazines and books of magazine thickness, two types of bindings are in use. The most common type of binding for such booklets is referred to as conventional "saddle binding," in which all of the signatures and the cover, are folded in the middle to form a V-shaped spine, gathered together, and bound by a saddle stitch; i.e., two staples at the vertex of the V-shaped spine. A known variation of saddle binding enables the use of a flat spine or back which is of squarish cross section. In this variation, the signatures are sewn together at their vertex, and then glued to the spine inside the cover. This variation is quite costly, however, relative to conventional saddle stitching and is more like "perfect binding" explained below.

The second type of binding, referred to in the art as "perfect binding," typically occurs when a series of folded signatures are stacked flatly one on top of another to form a flat spine, with the stacked signatures being subsequently glued together along the bound edge. Perfect binding is more costly than conventional saddle binding, but is the binding of choice when it is necessary to put any printing on the spine so that, for example, a title of a book could be read while the booklet is on a shelf It is also known to secure a perfect binding in a thinner book by stitches or staples which are disposed adjacent to the spine and perpendicular to the plane of the cover. The production of perfect bound copies calls for a different type of binding machine, also quite costly, and similarly requires trimming and stacking as the final production steps.

Saddle binders are intended for high production, on the order of 15,000 books per hour or more, and comprise a number of subassemblies integrated for synchronous operation. Such unitized machines are quite costly and generally include a signature feeder, a cover folder and feeder, a saddle, a caliper, a stitcher, a delivery bed, a trimmer, and a continuous conveyor assembly or gathering chain for servicing delivery to each subassembly.

The most pertinent prior art known to applicants is listed herewith in numerical order with no significance intended to the ordering.

U.S. Pat. No. 1,196,912 to Weck describes a self-contained mechanism capable of scoring a paper along parallel lines spaced apart by any distance. This device, however, does not incorporate or suggest the use of a saddle stitch in order to simplify the binding process.

U.S. Pat. No. 1,525,238 to Hurd describes an apparatus for slotting and scoring box-board materials with a pair of slotting blades spaced apart by a prescribed distance.

U.S. Pat. Nos. 5,045,045 and 5,133,235 to Davenport et al. describe a combination skip-score skip-perforator apparatus through which a web is fed. The scoring/perforating apparatus includes first and second roller attachments, one of which has a scoring or perforating blade, and the other has a resilient abutment portion for engaging the blade.

SUMMARY OF THE INVENTION

The invention overcomes the limitations of the prior art by providing an inexpensive and efficient method for forming a flat cover spine by employing a conventional saddle stitch to bind the publication. In accordance with the invention, an apparatus is provided for gathering and saddle stitching at least one cover and a plurality of signatures to form a book. The apparatus includes a scoring station for scoring the cover and defining a flat spine therefore.

A stitching station is provided for stitching together the cover and the signatures through at least one stitch in the flat spine, thereby binding together the cover and the signatures. Means are provided for conveying the cover from the scoring station to the stitching station. The scoring station includes scoring means for providing a pair of substantially parallel scores in the cover, the scores being separated by a predetermined distance equal to a desired width of the flat spine.

The scoring station comprises a pair of scoring disks. Each of the disks is adapted to produce one of the parallel scores. Each of the disks maintains a pressure on the cover which is equal to a pressure maintained by the other of the scoring disks. In accordance with another aspect of the invention, the scoring station comprises a drum on which the cover is releasably secured during a scoring process. The scoring disks are biased toward the drum.

The scoring station further comprises a pair of annular grooves associated with the scoring drum. The cover rides on the drum between the grooves and the scoring disks during the scoring process. The scoring disks are partially received within the grooves during the scoring process, thereby creating the scores.

In accordance with another aspect of the invention, the scoring station can include one or more rings, adapted to be releasably mounted on the drum, so as to fit in the annular groove. The scoring disks and the one or more rings are interchangeable with other similar disks and rings, so as to produce different widths of the flat spine.

In accordance with another aspect of the invention, the scoring station further comprises a folding assembly for folding the cover along the parallel scores. The folding assembly includes a carrying belt having a substantially flat upper face for carrying the cover. The carrying belt also has a width substantially corresponding to the desired width of the flat spine. Means are also provided for moving the carrying belt.

The means for moving the carrying belt comprise a V-belt assembly having a V-belt with a pair of inside edges and a vertex. The inside edges frictionally engage the outside edges of the carrying belt. The cover rides the carrying belt such that the flat spine is centered on the flat upper face. As the cover passes between the flat upper face and the V-belt, the inside edges of the V-belt urge the cover to bend along the parallel scores. The folding assembly also includes a set of squeeze rollers that squeeze together front and back sides of the cover below the flat spine.

In accordance with a further aspect of the invention, the stitching station includes a block guide having a lower channel with a width substantially equal to the desired width. An anvil is positioned so that the cover and the plurality of signatures are stabilized between the block guide and the anvil prior to the stitching function. The stitching station also comprises a stitching head, and a stationery guide positioned ahead of the stitching head and over the conveyor means. The stationery guide includes an elongated channel with a notch at its base having a width substantially equal to the desired width.

BRIEF DESCRIPTION OF THE DRAWINGS

The invention will now be described with reference to the drawings in which.

DETAILED DESCRIPTION OF THE PREFERRED EMBODIMENTS

Figure 7:
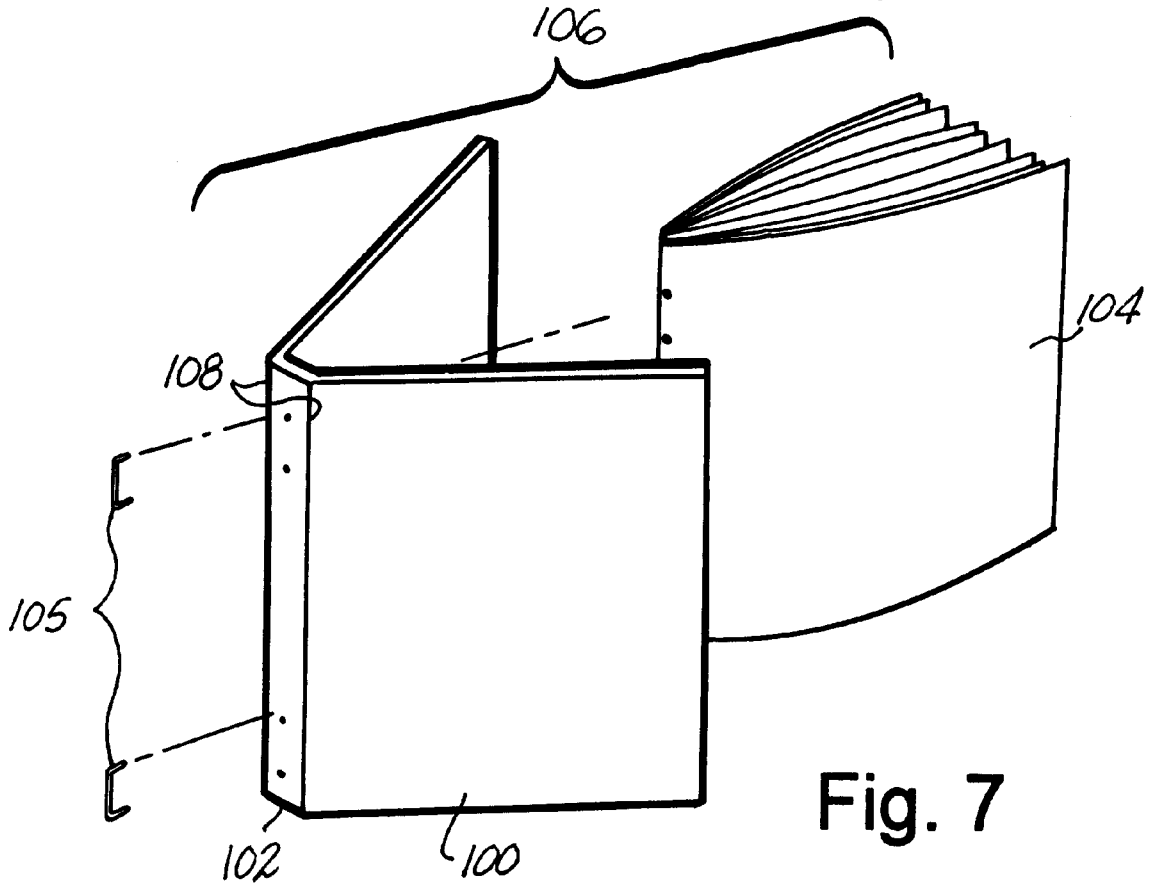
FIG. 7 is an exploded view of a saddle-stitched, flat-spined book, with components for assembly according to the invention.

A saddle binding operation according to the invention will produce a flat spine book wherein the cover and signature or signatures are bound by a saddle stitch through the spine. Such a product is illustrated in FIG. 7. A saddle binding assembly to produce a book as shown in FIG. 7 includes subassemblies for scoring and folding a cover 100 with dual score lines 108 to define the spine 102, for feeding a preassembled signature 104, for gathering the folded cover 100 and the preassembled signature 104, for binding the gathered cover 100 and signature 104 with one or more saddle stitches 105, for trimming the edges of the bound cover 100 and signature 104, and for stacking a completed book 106. The present invention lies in improvements to the scoring and folding subassembly, the stitching subassembly and the method of binding.

Figure 1:
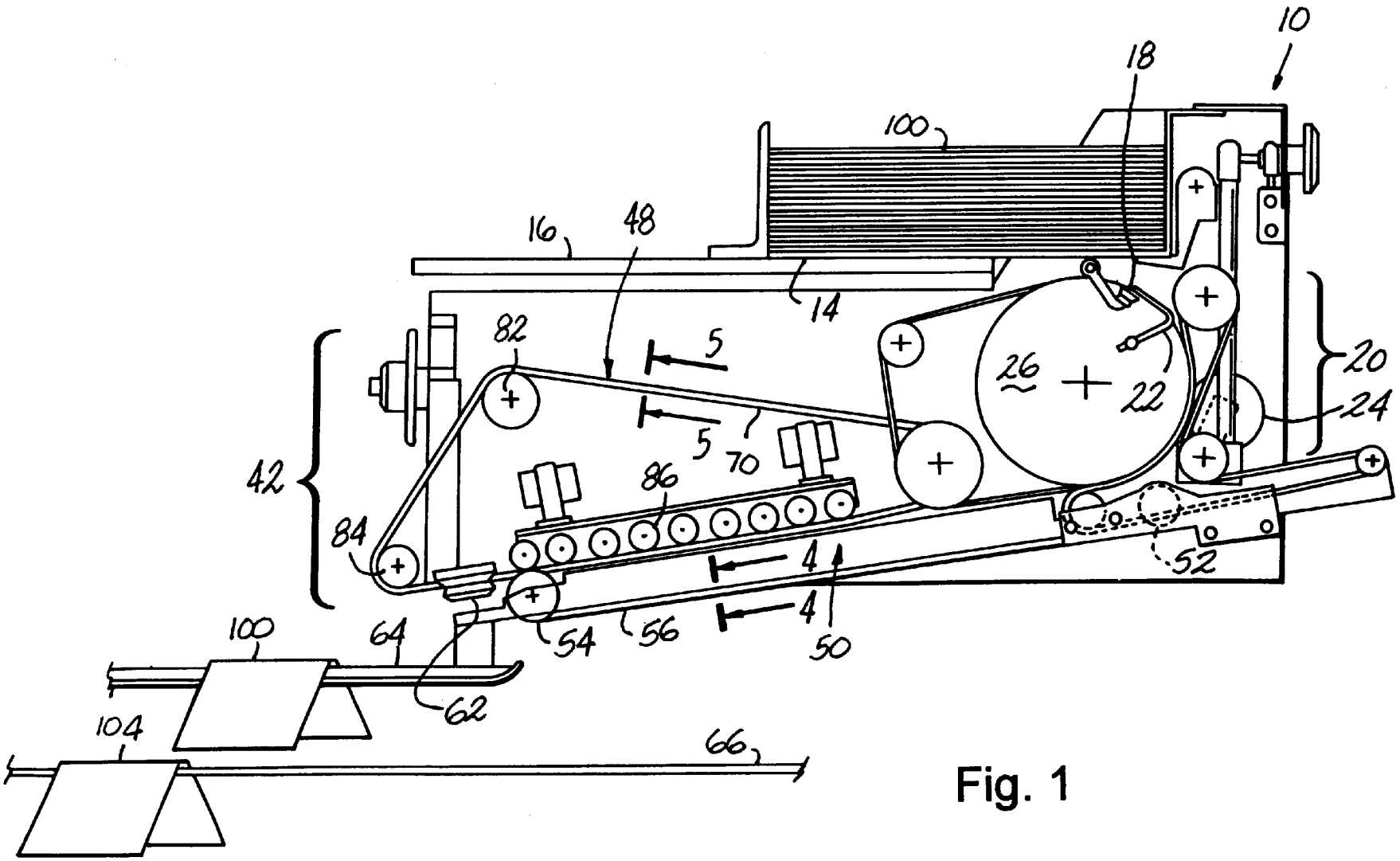
FIG. 1 is an elevational view of a dual-scoring, flat-spine-folding and feeding subassembly according to the invention.
Figure 6:
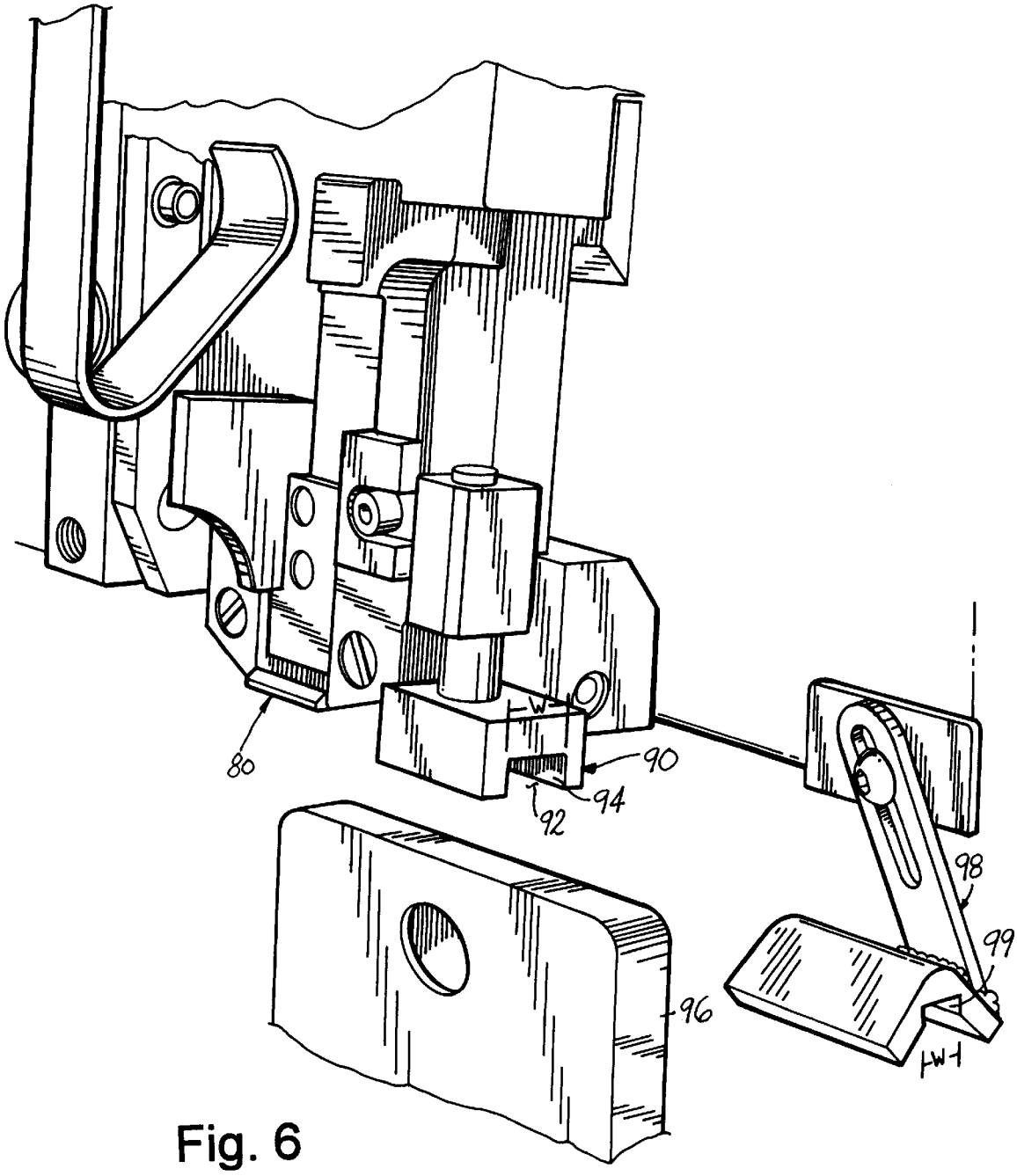
FIG. 6 is a perspective view of the stitching head and block guide of the stitching subassembly according to the invention.

A dual-scoring and flat-spine folding device 10 for forming a flat spine 102, which is a planar spine or back of squarish cross-section, is shown generally in FIG. 1, and an improved stitching head 80 of a saddle stitching device (not shown) for inserting a saddle stitch through the flat spine 102 of the cover 100 and the assembled signatures 104 to bind the publication is shown generally in FIG. 6. The dual-scoring and flat-spine folding device 10 is a modified version of a conventional scoring and folding device such as the Müller Martini AG Folder-Feeder Model 1529. The stitching head 80 is a modified version of a conventional stitching head such as the Müller Martini AG Stitcher Head Model 882. A conventional gathering chain 66 collates and carries the covers 100 and signatures 104 between the scoring and folding device 10 and the saddle stitching device and thereafter between the saddle stitching device and a trimming device.

The dual scoring and flat-spine folding device 10 generally comprises a feeding table 16, a sucker arm 18, a scoring subassembly 20, and a folding subassembly 42. Preprinted covers 100 are stacked on the feeding table 16, inside up, from which the sucker arm 18, located below the stack of individual covers 100, pulls the bottom cover 14 from the stack so that it may be scored and folded.

Figure 2:
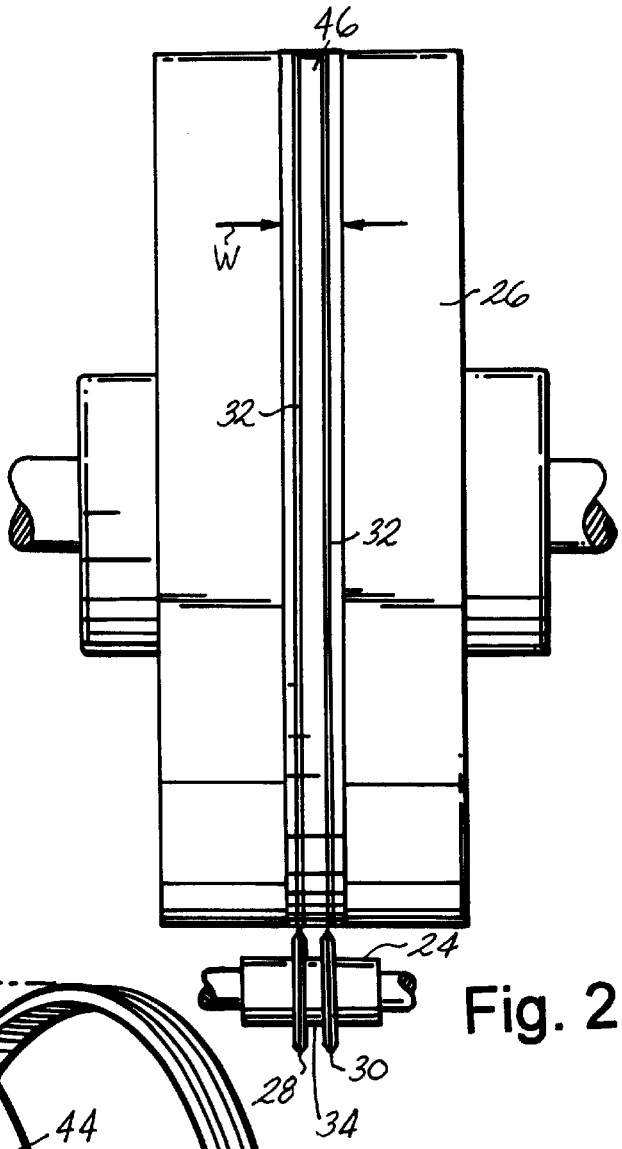
FIG. 2 is a fragmentary view of the scoring drum and scoring wheel of FIG. 1.
Figure 3:
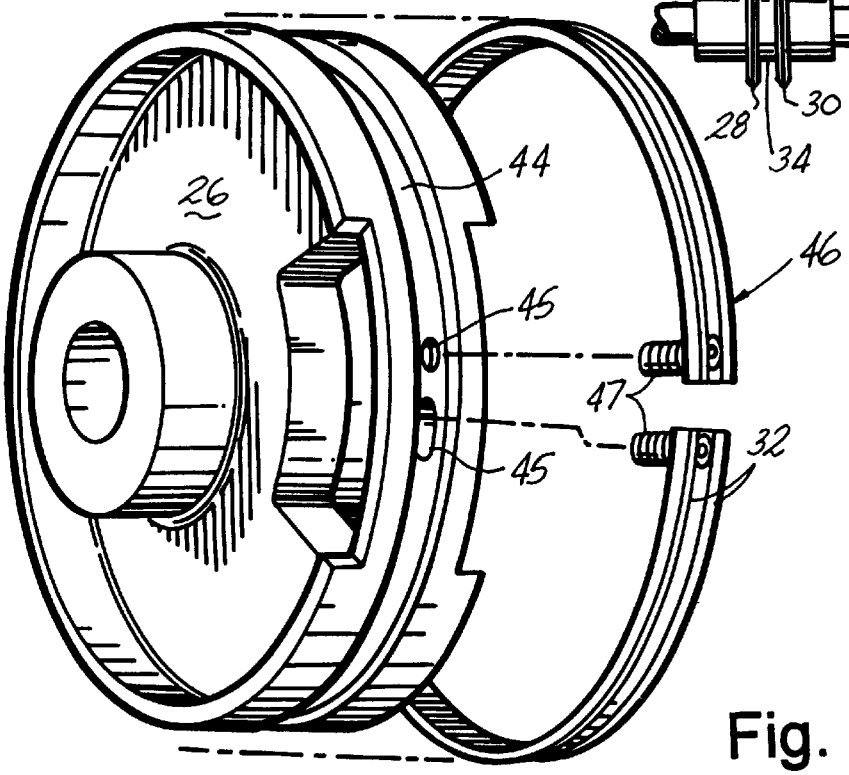
FIG. 3 is an exploded view of the scoring drum.

The scoring subassembly 20, as best seen in FIGS. 1 and 2, includes a cylindrical scoring drum 26, which rotates clockwise (in FIG. 1) and receives an individual cover 14 from the sucker arm 18. A gripper 22, adjacent to the scoring drum 26, clamps the cover 14 to the rotating scoring drum 26. The scoring subassembly also includes a scoring wheel 24. As seen in FIGS. 2 and 3, the scoring drum 26 has an annular channel 44 with a pair of apertures 45 through the base of the channel. A split ring 46 with two clamp arms 47 extending radially inwardly from the ends of the ring is received within the channel 44 so that the clamp arms 47 extend through the apertures, and the ring nests within the channel. The clamp arms 47 are clamped together in conventional manner, for example, by a bolt and nut, to secure the ring 46 to the drum 26. The ring 46 has a pair of annular grooves 32, each with a narrow width typically of 1/16 inch or less. The distance between the grooves 32 will be a width W.

In another embodiment, not shown, the ring 46 will be formed of two half-rings secured to each other, and have a single annular groove of width W. It will be understood that there are several rings 46, each having a different predefined width W. Thus, being fully interchangeable, the rings 46 permit different spine widths of thickness Was will be explained below.

In yet another embodiment, not shown, the annular groove or grooves 32 will be formed by machining them directly in the drum 26.

The scoring drum 26 matingly receives the scoring wheel 24, which rotates on an axis parallel to the scoring drum 26.

As best shown in FIG. 2, the scoring wheel 24 includes two parallel creasing disks 28 and 30 in coaxial relation to the scoring wheel 24 and separated from each other by predefined width W. The distance W between the peripheral edges of the scoring disks 28 and 30 corresponds to the desired width of the flat spine 102. It will be understood that each creasing disk 28, 30 is somewhat dull or rounded at its peripheral edge so as to minimize the risk of cutting or tearing completely through a cover 100 as it is scored. Each creasing disk 28, 30 mates with a corresponding annular groove 32 on the drum 26. When a cover 100 passes between the scoring wheel 24 and the scoring drum 26, the proximity of the creasing disks 28 and 30 and the grooves 32 scores the cover 100 along parallel lines 108 (see FIG. 7).

It is important that the creasing disks 28, 30 each maintain the same pressure in their respective grooves 32 in order to obtain an optimally balanced flat spine 102. Thus, the axes of the drum 26 and the scoring wheel 24 must be parallel, assuming even wear on the disks 28, 30. An alternative embodiment, not shown, has the creasing disks 28, 30 mounted to separate rotating shafts, and biased into the grooves 32 independently, with a conventional adjustment mechanism to maintain nearly identical pressures.

Figure 4:
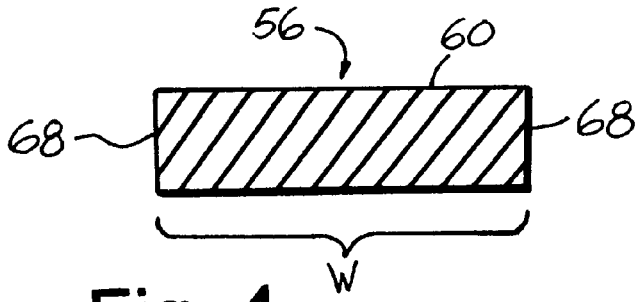
FIG. 4 is a perspective view of a section of the flat carrying belt taken along line 4—4 in FIG. 1.

Returning now to FIG. 1, the folding subassembly 42, which is located contiguous to the scoring drum 26, generally comprises a V-belt assembly 48, sword 50, a flat carrying belt 56, guide pulleys 52 and 54, a squeeze roller 62, and an extension 64. The sword 50 receives covers 100 having dual scores defining parallel fold lines 108 from the scoring drum 26 with the inside of the covers facing down. Opposite ends of the sword 50 have the guide pulleys 52 and 54 for guiding the endless flat carrying belt 56 around the sword 50. As shown by FIG. 4, the flat carrying belt 56 includes a top face 60 and outside edges 68. The flat top face 60 of the interchangeable flat belt 56 is substantially the same width Was the flat spine 102 just scored by the scoring drum 26 and is adapted to carry an individual cover 100 over the sword 50, away from the scoring drum to be folded along the scored lines 108. It will be understood that the scored lines 108 will lie immediately next to the outside edges 68 of the flat carrying belts.

Figure 5:
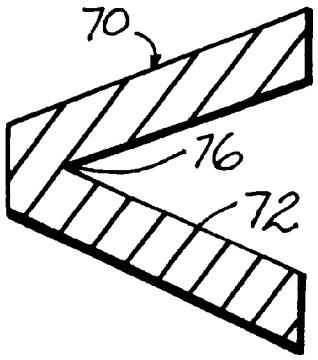
FIG. 5 is a perspective view of a section of the V-belt taken along line 5—5 in FIG. 1.

The flat carrying belt 56 is powered by the V-belt assembly 48, which includes a V-belt 70 traveling around large pulleys 84, a series of small pulleys 86, and a powered wheel 82. The V-belt 70 opens outwardly, having inside edges 72 and a vertex 76, as shown in FIG. 5 and rotates clockwise in FIG. 1. Driven by the wheel 82 located above the sword 50, the inside edges 72 of the V-belt frictionally engage the outside edges 68 of the flat carrying belt 56. The motion of the V-belt 70 urges the flat carrying belt 56 to rotate in a counterclockwise direction as seen in FIG. 1 around the free-wheeling guide pulleys 52, 54. The cover 100 rides the flat carrying belt 56 saddle-wise, with the flat spine 102 of the cover 100 centered upon the top face 60 of the flat carrying belt 56. As a cover 100 passes between the top face 60 of the flat carrying belt 56 and the V-belt 70, the inside edges 72 urge it to bend along its prescored fold lines 108.

At the exiting end of the sword 50 are a pair of opposing squeeze rollers 62, as shown in FIG.1. The squeeze rollers 62, which are of the conventional type, squeeze the front and back of the cover 100 toward each other just below the flat spine 102 as the folded cover 100 passes therebetween along the sword 50 to complete the folding process. The extension 64, which is located adjacent to and below the squeeze rollers 62 at the exiting end of the sword 50, receives and guides the folded covers 100 to the gathering chain 66 where the covers 100 are collated with the signatures 104 in conventional manner.

It will be appreciated that additional guide rollers similar to 54 may be positioned adjacent the engagement of the V-belt 70 with the flat belt 56 to facilitate folding. Moreover, it has been found that making the guide roller 54 adjustable so that it may be selectively positioned near or between the pinch rollers 62 enhances the folding step.

A conventional saddle stitching machine includes an improved stitching head 80, as shown in FIG. 6, comprising a block guide 90, both of which descend upon an anvil 96 when a staple 105 is inserted through the assembled cover 100 and signatures 104. The block guide 90 has a notch 92 extending its length at the bottom of which is generally a rectangular channel 94 with a width substantially equal to W. The width of the block guide channel 94 is substantially equal to the width of the flat spine 102, whereby covers 100 and signatures 104 are stabilized between the block guide 90 and the anvil 96 prior to stapling. A guide 98 is mounted to the saddle stitching machine away from the stitching head 80, but over the gathering chain 66 in the path of the covers 100 before they reach the stitching head. The guide 98 assists directing the preassembled covers 100 and signatures 104 toward the anvil 96, and is stationary relative to the reciprocal motion of the stitching head 80. The guide 98 includes an elongated channel with a square notch 99 at its base having a width substantially equivalent to the width W. The gathering chain 66 passes below the block guide 90 and the stitching head 80, whereby the assembled and stapled covers 100 and signatures 104 are carried to a conventional trimming machine.

In operation, covers 100 are placed into stacks on the feeding table 16. The bottom cover 100 is separated from the stack by the sucker arm 18 and pulled around the scoring drum 26. The gripper 22 quickly clamps the cover 100 to the drum 26.

As the cover 100 is pulled around the drum 26, the cover 100 is double-scored by the scoring wheel 24. The scoring wheel 24 scores the cover 100 along two parallel lines separated by a predetermined distance W corresponding to the distance between creasing disks 28 and 30. The scoring wheel 24 and/or creasing disks 28, 30, and the ring 46 are interchangeable such that any desired flat spine cover width may be chosen. The maximum limitation on flat spine width is generally the width at which a conventional saddle-binding trimmer can no longer trim the bound covers 100 and signatures 104 effectively, which is approximately ¼ to 5/16 inch, although with adjustments to the trimmer, larger spines may be acceptable. Generally, a minimum flat spine width is defined by the requirement for printed matter on the spine, usually no smaller than ⅛ inch.

The sword 50, the flat carrying belt 56, and the V-belt assembly 48 concertedly fold the cover 100 along the prescored parallel lines 108 set by the creasing disks 28 and 30 of the scoring wheel 24. The V-belt assembly 48 is a conventional arrangement whereby the vertex of a typical saddle-bound spine rides a round, thin belt through the vertex of the V-belt 70. In the present embodiment, the flat carrying belt 56 is powered by a V-belt assembly 48 superior to the top-side of the folding assembly 42 and frictionally engaging the outside edges 68 of the top face 60 of the flat belt 56, whereby the clockwise rotation of the V-belt 70 forces the flat belt 56 in a counterclockwise direction. A cover 100 rides the flat carrying belt 56 saddle-wise, with the flat spine 102 of the cover 100 approximately equal in width with and centered upon the top face 60 of the flat carrying belt 56, and passes between the top face 60 of the flat carrying belt 56 and the V-belt 70. The cover 100 is folded along its prescored lines when the inside edges 72 of the V-belt 70 engage the outside edges 68 of top face 60 of the flat carrying belt 56 with the cover 100 therebetween.

The opposed squeeze rollers 62, which are of the conventional type, squeeze the front and back of the cover 100 toward each other just below the flat spine 102 as the folded cover 100 passes therebetween along the sword 50. The extension 64, which is located adjacent to the squeeze rollers 62 and at the exiting end of the sword 50, guides the flat-spined covers 100 onto the gathering chain 66. The gathering chain 66 synchronously carries preassembled signatures 104 upon which a folded and scored cover 100 is placed as it drops off of extension 64 onto the gathering chain 66.

The gathering chain 66 carries the assembled packets of covers 100 and signatures 104 to the stitching machine where the block guide 90 receives the flat spine 102 of the cover 100 in order to stabilize the cover 100 immediately prior to the insertion of a staple 105 by the stitching head 80. The anvil 96 receives and folds inward the leading edges of each inserted staple 110. After stapling, each bound cover 100 and its bound signatures 104 are carried along the gathering chain 66 to a conventional trimmer (not shown) 100 where the edges of the cover and signatures 104 are shaved to produce a clean edge.

Reasonable variation and modification are possible within the spirit of the foregoing specification and drawings without departing from the scope of the invention.

The embodiments of the invention in which an exclusive property or privilege is claimed are defined as follows:

1. An apparatus for gathering and saddle stitching at least one cover and a plurality of signatures to form a book, said apparatus comprising:

a scoring station for scoring said cover and defining a flat spine therefore;

a stitching station for stitching together said cover and said signatures through at least one stitch in said flat spine, thereby binding together said cover and said signatures;

means for conveying said cover from said scoring station to said stitching station; and said scoring station comprises scoring means for producing a pair of substantially parallel scores in said cover, said scores being separated by a predetermined distance equal to a desired width of said flat spine.

2. An apparatus in accordance with claim 1, characterized in that said scoring station comprises a pair of scoring disks, each of said disks adapted to produce one of said parallel scores.

3. An apparatus in accordance with claim 2, characterized in that each of said disks maintains a pressure on said cover equal to a pressure maintained by the other of said scoring disks.

4. An apparatus in accordance with claim 2, characterized in that said scoring station further comprises a drum on which said cover is releasably secured during a scoring process, and said scoring disks are biased toward said drum.

5. An apparatus in accordance with claim 4, characterized in that said scoring station further comprises a pair of annular grooves associated with said scoring drum, so that said cover rides on said drum between said grooves and said scoring disks during said scoring process, and said scoring disks are partially received within said grooves during said scoring process, thereby creasing said cover.

6. An apparatus in accordance with claim 5, characterized in that said scoring station further comprises one or more rings, adapted to be releasably mounted to said drum, so as to form said annular grooves.

7. An apparatus in accordance with claim 6, characterized in that said scoring disks and said one or more rings are interchangeable with other similar disks and rings, so as to produce different widths of said flat spine.

8. An apparatus in accordance with claim 1, characterized in that said scoring station further comprises a folding assembly for folding said cover along said parallel scores, said folding assembly comprising:

a carrying belt having a substantially flat upper face for carrying said cover, said carrying belt also having a width substantially corresponding to said desired width of said flat spine; and means for moving said carrying belt.

9. An apparatus in accordance with claim 8, characterized in that said means for moving said carrying belt comprises a V-belt assembly having a V-belt with a pair of inside edges and a vertex, whereby said inside edges frictionally engage outside edges of said carrying belt.

10. An apparatus in accordance with claim 9, characterized in that said cover rides said carrying belt such that said flat spine is centered on said flat upper face, and as said cover passes between said flat upper face and said V-belt, said inside edges urge said cover to bend along said parallel scores.

11. An apparatus in accordance with claim 10, characterized in that said folding assembly further comprises a set of squeeze rollers for squeezing together front and back sides of said cover below said flat spine.

12. An apparatus in accordance with claim 1, characterized in that said stitching station comprises a block guide having a lower channel with a width substantially equal to said desired width.

13. An apparatus in accordance with claim 12, characterized in that said block guide is positioned so that said cover and said plurality of signatures are stabilized within said lower channel prior to stitching together said cover and said signatures.

14. An apparatus in accordance with claim 1, characterized in that said stitching station comprises:

a stitching head; and a stationery guide positioned ahead of said stitching head and over said conveyor means, said stationary guide having an elongated channel with a notch substantially equal to said desired width.

15. An apparatus for gathering and saddle stitching at least one cover and a plurality of signatures to form a book, said apparatus comprising:

a scoring station for scoring said cover and defining a flat spine therefore, said scoring station comprising a pair of parallel scoring disks, a drum on which said cover is releasably secured during a scoring process, said scoring disks being biased toward said drum, and one or more annular grooves associated with said scoring drum, with said cover riding on said drum between said one or more grooves and said scoring disks during said scoring process, and with said scoring disks partially received within said one or more grooves during said scoring process;

a stitching station for stitching together said cover and said signatures through at least one stitch in said flat spine, thereby binding together said cover and said signatures; and means for conveying said cover from said scoring station to said stitching station.

16. An apparatus in accordance with claim 15, characterized in that said annular grooves are formed through the use of one or more rings adapted to be releasably mounted on said drum.

17. An apparatus in accordance with claim 15, characterized in that said scoring station comprises a folding assembly having a carrying belt with a substantially flat upper face for carrying said cover, said carrying belt also having a width substantially corresponding to said desired width of said flat spine.

18. An apparatus in accordance with claim 15, characterized in that said stitching station comprises a block guide having a lower channel with a width substantially equal to said desired width.

19. An apparatus in accordance with claim 18, characterized in that said stitching station further comprises:

a stitching head; and a stationary guide positioned ahead of said stitching head, said stationary guide having an elongated channel with a notch at its base having a width substantially equal to said desired width.

* * * * *